United States Patent [19]

Altherr

[11] 4,438,855

[45] Mar. 27, 1984

[54] RAILWAY COUPLER SHELF CHAMFER

[75] Inventor: Russell G. Altherr, Munster, Ind.

[73] Assignee: Amsted Industries Incorporated, Chicago, Ill.

[21] Appl. No.: 341,307

[22] Filed: Jan. 21, 1982

[51] Int. Cl.[3] ..... B61G 3/04; B61G 7/00

[52] U.S. Cl. ..... 213/153; 213/109

[58] Field of Search ..... 213/75 R, 100 R, 153, 213/109

[56] References Cited

U.S. PATENT DOCUMENTS 2,214,718 9/1940 Christianson ..... 213/153

2,719,634 10/1955 Metzger ..... 213/153

3,606,032 9/1971 DePenti ..... 213/153 X 4,129,219 12/1978 Polanin ..... 213/153 X

*Primary Examiner*—Randolph Reese

*Attorney, Agent, or Firm*—Edward J. Brosius; Fred P. Kostka

[57] ABSTRACT

A railway coupler having a coupler head and a support shelf extending from the lower portion and in some couplers, from the upper portion as well, of the coupler head is provided. A chamfer is provided on the front and side edges of the support shelf and also on the front and side edges of the auxiliary interlocking lug to decrease the possibility of the raising of one coupler during an adverse vertical angling coupling operation.

1 Claim, 5 Drawing Figures

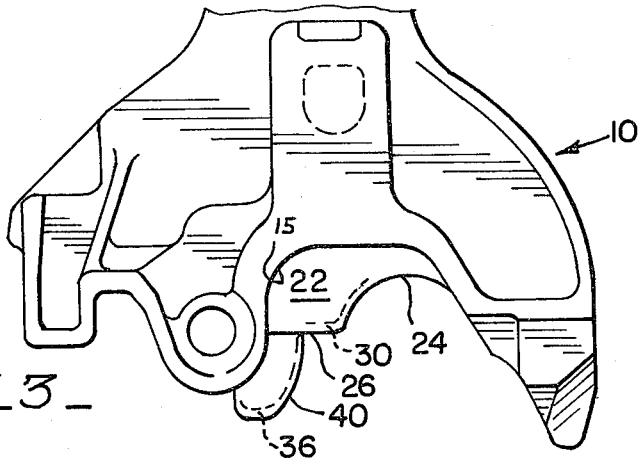
FIG. 3
FIG. 1
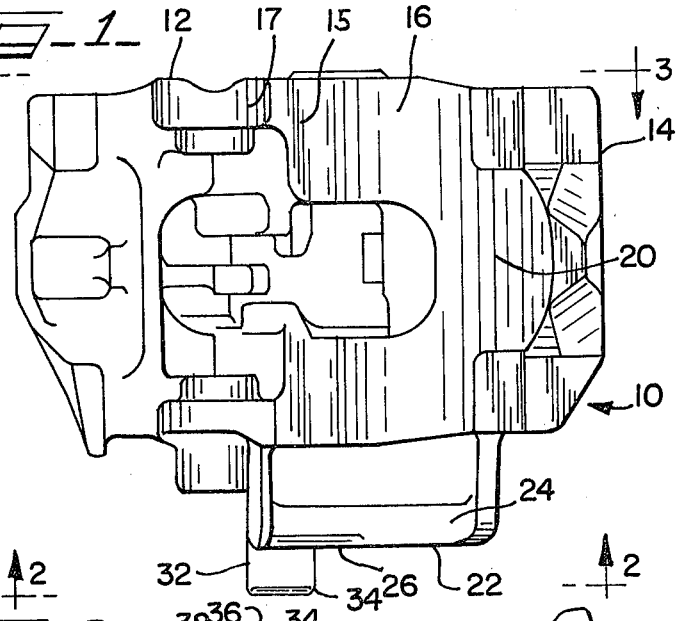
FIG. 2
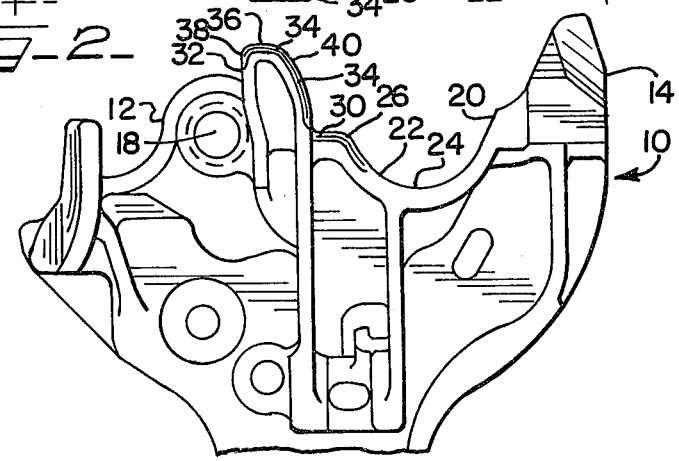

RAILWAY COUPLER SHELF CHAMFER

BACKGROUND OF THE INVENTION

The present invention relates to railway couplers, and more particularly to a railway coupler having a shelf with chamfered side edges.

Both Type E and Type F railway couplers are known to have lower support shelves. Further, double shelf type E and F couplers are known with both an upper and a lower support shelf. One purpose of such support shelves is to assist in limiting relative vertical motion between couplers. Another purpose, as set forth in U.S. Pat. No. 3,627,145, is to support a mating coupler in the event it is pulled out of engagement with its supporting railway vehicle.

As shown in U.S. Pat. No. 4,129,219, an angled leading edge of the top shelf of an E Type coupler is known to prevent shelf to shelf load transfer under a droop coupler condition.

One problem with couplers having known support shelves and auxiliary support lugs has been a tendency for shelf overlap, and, especially in the case of relative slight coupler rotation, the contact or overlap of top and bottom shelves. Such shelf contact or overlap usually requires a combination of coupler droop and contour wear with resulting severe vertical coupler angling. In fact, a loss of rail contact due to the lifting of one coupler is an actual consideration. Such loss of rail contact is a serious enough problem to consider modification to coupler design.

Accordingly, it is an object of the present invention to provide an improved railway coupler that will lessen the potential for shelf overlap and the lifting of coupler-car trucks from track contact during such shelf overlap.

SUMMARY OF THE INVENTION

Type E railway couplers are of both a single lower shelf and a double shelf (upper and lower) design. Type F railway couplers are of both a single lower shelf and a double shelf design and have an auxiliary interlocking lug as well.

The present invention involves a modification to the lower shelf of Type E single shelf couplers, the lower and upper shelves of Type E double shelf couplers, and the lower shelf, upper shelf (when present) and the auxiliary interlocking lug of Type F couplers. The modification comprises the chamfering of the side edges of the lower shelf and auxiliary interlocking lug. Such chamfering lessens the possibility for loss of wheel-rail contact due to the lifting of a car truck during an overlap of shelves or auxiliary interlocking lugs.

In particular, the present invention provides a railway car coupler comprising a head, having a knuckle side and a guard arm side, said head further having a lower support shelf extending outwardly from a lower portion of said head, said lower support shelf having a chamfer on a side surface of said shelf, said chamfer extending downwardly and away from the guard arm side of the coupler head.

The coupler may also include an upper support shelf extending from an upper portion of said head, said upper support shelf having a chamfer on its upper front surface, said chamfer extending upwardly and toward the front face of the coupler head.

The couplers may also include an auxiliary interlocking lug extending from a section of the lower portion of said head below said lower support shelf, said auxiliary interlocking lug having a chamfer on the guard arm facing side surface of said lug, said chamfer extending downwardly and away from the guard arm side of the coupler head.

BRIEF DESCRIPTION OF THE DRAWINGS

In the drawings,

FIG. 1 is a frontal view along the longitudinal center line of a Type F coupler head embodying a preferred form of the present invention;

FIG. 2 is a bottom view of a Type F coupler head embodying a preferred form of the present invention;

FIG. 3 is a top view of a Type F coupler head embodying a preferred form of the present invention;

DESCRIPTION OF THE PREFERRED EMBODIMENT

Figure 4:
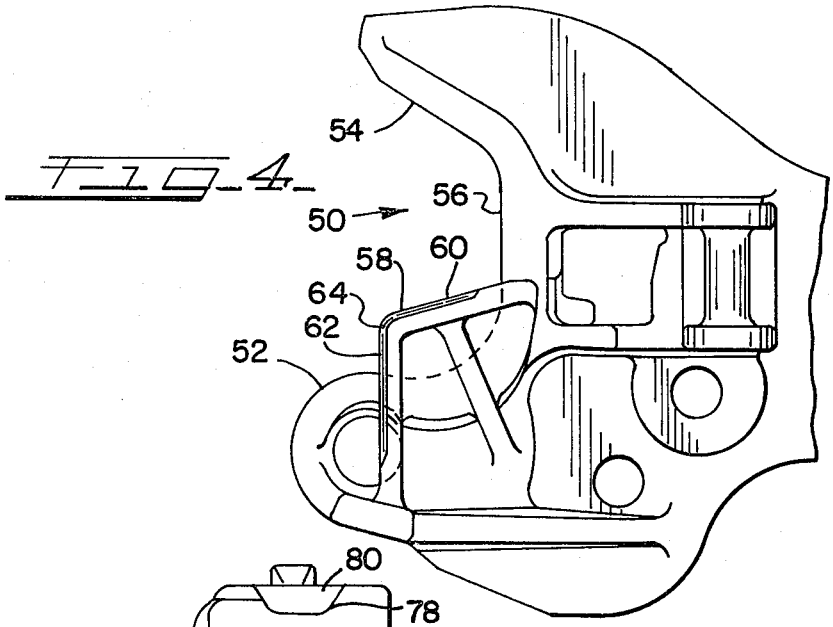
FIG. 4 is a bottom view of a Type E single shelf coupler head embodying a preferred form of the present invention.

In FIGS. 1–3, a Type F coupler head is shown generally at 10. The knuckle side of the coupler is shown at 12, and the guard arm side at 14. As best seen in FIG. 1, coupler front face 16 is a generally flat, vertical planar section. Coupler face 16 includes throat portion 15 extending toward knuckle side 12 in a curved manner toward pivot lug 17 having a pin hole 18. Coupler face 16 extends toward guard arm side 14 in a generally angular manner to form guard arm face 20. Extending from the under side of coupler head 10 is support shelf 22. Support shelf 22 extends from knuckle side 12 toward guard arm side 14 of coupler head 10 with a substantially straight section 26 and then a curved section 24.

A chamfer or angled section 30 is formed along the edge of shelf curved section 24 and may extend to a portion or all of straight section 26. Typically, chamfer 30 is at an angle of from 45° or less from the vertical center line of coupler head 10. Chamfer 30 may comprise a flat or a convex surface.

Also extending from the lower end of coupler head 10 is auxiliary interlocking lug 32. Auxiliary interlocking lug 32 extends below and towards the coupler knuckle side 12 from support shelf 22, and auxiliary interlocking lug 32 extends outward away from coupler front face 16 farther than coupler shelf 22. Auxiliary interlocking lug 32 is generally tongue shaped and comprises a front edge 36, a knuckle side edge 38 and a guard arm side edge 40. A chamfer or angled section 34 is formed along guard arm side edge 40 of auxiliary interlocking lug 32. Chamfer 34 may extend into front edge 36 and knuckle side edge 38. Typically, chamfer 34 is at an angle of less than 45° from the vertical center line of coupler head 10. Chamfer 34 may comprise a flat or a convex surface.

In FIG. 4, a Type E coupler head is shown generally at 50. FIG. 4 is a bottom view of coupler head 50, and knuckle side 52, front face 56 and guard arm side 54 are shown. Extending below front face 56 is lower shelf 58. Lower shelf 58 extends from about the center line of front face 56 in a straight section 60 and then curves into a straight section 62 which intersects with knuckle side 52 of coupler head 50 at a right angle to the longitudinal axis of the coupler.

Along the outer edge of lower shelf 58 is a chamfer or angled section 64. Chamfer 64 extends along the outer edge of sections 60 and 62 of lower shelf 58. Typically, chamfer 64 is at an angle of less than 45° from the vertical center line of coupler head 50. Chamfer 64 may comprise a flat or a convex surface.

Figure 5:
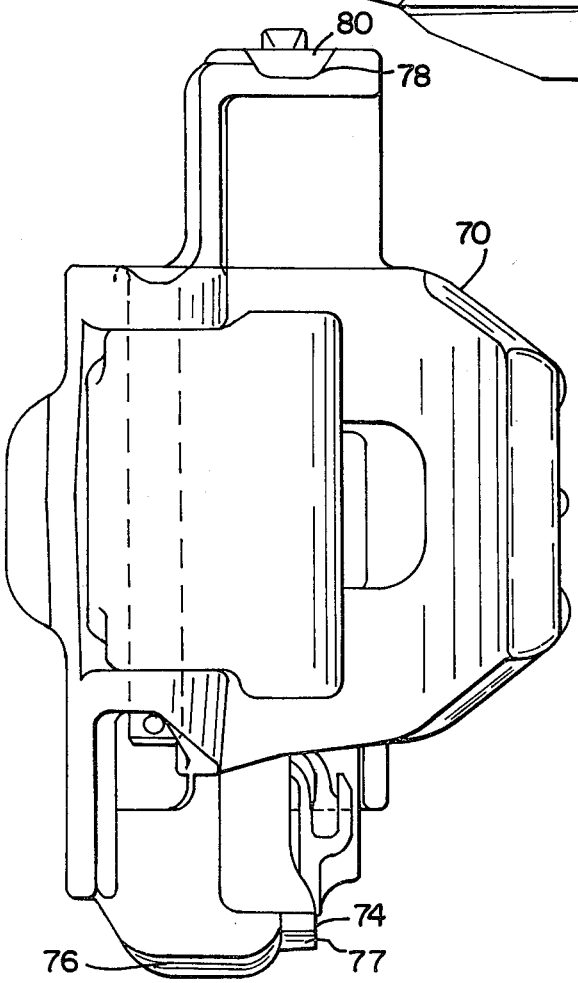
FIG. 5 is a front view of a Type E double shelf coupler head embodying a preferred form of the present invention.

In FIG. 5, a Type E double shelf coupler head is shown generally at 70. FIG. 5 is a front view of coupler head 70. Extending from the lower section of coupler head 70 is lower support shelf 74. Extending from the upper section of coupler head 70 is upper shelf 78. A chamfer or angled section 76 is formed along the front edge of lower support shelf 74, and chamfer 77 extends along the side edge of lower support shelf 74. Typically, chamfers 76 and 77 are at angles of less than 45° from the vertical center line of coupler head 70. A chamfer or angled section 80 is formed along the front edge and extending along to the side edge of upper support shelf 78. Typically, chamfer 80 is at an angle of less than 45° from the vertical center line of coupler head 70. Chamfers 76, 77 and 80 may comprise a flat or a convex surface.

Although preferred embodiments of the present invention have been described, the scope of the present invention is set forth in the following claim.

What is claimed is:

1. A railway car coupler comprising a head including a throat portion, a knuckle pivotally connected to the head at one side of the longitudinal vertical centerplane of the head, a generally planar, lower shelf extending from the head below the knuckle, said lower shelf extending from an intersection with the throat to a point substantially adjacent the pivot of the knuckle, said lower shelf having a front edge surface and a side edge surface, and a chamfer on the side edge surface and part of the front edge surface of the lower shelf, said chamfer extending downwardly and away from the guard arm side of the coupler head on the edge surface and downwardly and toward the coupler throat on the front edge surface.

* * * * *